US010018067B2

(12) United States Patent
Klasing et al.

(10) Patent No.: US 10,018,067 B2
(45) Date of Patent: Jul. 10, 2018

(54) SUCTION-BASED ACTIVE CLEARANCE CONTROL SYSTEM

(71) Applicant: General Electric Company, Schenectady, NY (US)

(72) Inventors: Kevin Samuel Klasing, Springboro, OH (US); Richard William Albrecht, Jr., Fairfield, OH (US); Brandon Flowers Powell, Cincinnati, OH (US); Mark Willard Marusko, Springboro, OH (US); Anthony Venzon, Middleton, OH (US); Thomas Ryan Wallace, Cininnati, OH (US)

(73) Assignee: General Electric Company, Schenectady, NY (US)

( * ) Notice: Subject to any disclaimer, the term of this patent is extended or adjusted under 35 U.S.C. 154(b) by 246 days.

(21) Appl. No.: 14/766,373

(22) PCT Filed: Jan. 9, 2014

(86) PCT No.: PCT/US2014/010764

§ 371 (c)(1),
(2) Date: Aug. 6, 2015

(87) PCT Pub. No.: WO2014/123654

PCT Pub. Date: Aug. 14, 2014

(65) Prior Publication Data

US 2015/0369077 A1 Dec. 24, 2015

Related U.S. Application Data

(60) Provisional application No. 61/762,590, filed on Feb. 8, 2013.

(51) Int. Cl.
*F01D 11/20* (2006.01)
*F01D 11/24* (2006.01)

(52) U.S. Cl.
CPC ..... *F01D 11/20* (2013.01); *F01D 11/24* (2013.01); *F05D 2260/606* (2013.01)

(58) Field of Classification Search
CPC ..... F01D 11/20; F01D 11/24; F05D 2260/606
See application file for complete search history.

(56) References Cited

U.S. PATENT DOCUMENTS 3,039,737 A 6/1962 Kolthoff, Jr.
3,800,864 A * 4/1974 Hauser ..... F01D 25/12 165/47

(Continued)

FOREIGN PATENT DOCUMENTS

CN 101078356 A 11/2007
CN 102482947 A 5/2012

(Continued)

OTHER PUBLICATIONS

PCT Search Report and Written Opinion issued in connection with corresponding PCT Application No. PCT/US2014/010764 dated May 23, 2014.

(Continued)

*Primary Examiner* — Mark Laurenzi
*Assistant Examiner* — Shafiq Mian
(74) *Attorney, Agent, or Firm* — General Electric Company; William Andes

(57) ABSTRACT

A clearance control apparatus for a gas turbine engine including an annular turbine case having opposed inner and outer surfaces; an annular manifold surrounding a portion of the turbine case, the manifold including: an inlet port in fluid communication with the manifold and the outer surface of the turbine case, and an exit port; and a bypass pipe having an upstream end coupled to the exit port, a downstream end coupled to a low-pressure sink, and a valve disposed between upstream and downstream ends, the valve selec- (Continued)

tively moveable between a first position which blocks flow between the upstream and downstream ends, and a second position which permits flow between the upstream and downstream ends.

8 Claims, 4 Drawing Sheets

(56) References Cited

U.S. PATENT DOCUMENTS 4,214,851 A * 7/1980 Tuley ..... F01D 5/18 415/115
4,329,114 A 5/1982 Johnston et al.
4,842,477 A 6/1989 Stowell
4,928,240 A 5/1990 Davison et al.
5,012,420 A 4/1991 Walker et al.
7,431,557 B2 10/2008 Herron et al.
8,668,431 B2 * 3/2014 Rog ..... F01D 11/24 415/1
9,206,742 B2 * 12/2015 Chuong ..... F01D 25/12
9,285,114 B2 * 3/2016 Tsumagari ..... F23D 11/408
2009/0180867 A1 7/2009 Massot et al.
2010/0071382 A1 * 3/2010 Liang ..... F01D 9/023 60/806
2011/0076135 A1 3/2011 Gendraud et al.
2012/0167584 A1 7/2012 Philippot
2013/0156541 A1 * 6/2013 Eleftheriou ..... F01D 11/20 415/1
2014/0245751 A1 * 9/2014 Chuong ..... F01D 25/12 60/796
2014/0341411 A1 * 11/2014 Mohindra ..... H04R 1/021 381/334

FOREIGN PATENT DOCUMENTS

EP 1314857 A2 5/2003
EP 1923538 A2 5/2008

OTHER PUBLICATIONS

Unofficial English Translation of Chinese Office Action issued in connection with corresponding CN Application No. 201480008045.1 dated Feb. 14, 2016.

* cited by examiner

SUCTION-BASED ACTIVE CLEARANCE CONTROL SYSTEM

BACKGROUND OF THE INVENTION

This invention relates generally to gas turbine engines, and more particularly to apparatus and methods for actively controlling the radial clearances between rotors and shrouds in the turbine sections of such engines.

A typical gas turbine engine includes a turbomachinery core having a high pressure compressor, a combustor, and a high pressure turbine in serial flow relationship. The core is operable in a known manner to generate a primary gas flow. The high pressure turbine or ("HPT") includes one or more rotors which extract energy from the primary gas flow. Each rotor comprises an annular array of blades or buckets carried by a rotating disk. The flowpath through the rotor is defined in part by a shroud, which is a stationary structure carried by a turbine case and which circumscribes the tips of the blades or buckets. These components operate in an extremely high temperature environment.

Blade tip clearances are a critical component of overall engine performance, especially the tip clearances in the HPT. Because gas turbine engines operate over a wide range of operating conditions, it is generally not possible to set the static blade tip clearances so as to maintain best efficiency while also avoiding "rubs" between the blade tips and the surrounding structure at all engine operating conditions. It is therefore known to actively control blade tip clearance by selectively heating and/or cooling the turbine case.

However, such systems are typically dependent on the use of complex, expensive manifold structures to deliver the heating or cooling air to the turbine case, and also require complex valving and piping to control the extraction and delivery of high-pressure bleed air to the manifolds.

Accordingly, there is a need for a means of providing active clearance control in a gas turbine engine with minimum weight and expense.

BRIEF SUMMARY OF THE INVENTION

This need is addressed by the present invention, which provides a suction-based active clearance control system which controls flow using a valve located downstream of an active clearance control manifold.

According to one aspect of the invention, a clearance control apparatus for a gas turbine engine includes: an annular turbine case having opposed inner and outer surfaces; an annular manifold surrounding a portion of the turbine case, the manifold including: an inlet port in fluid communication with the manifold and the outer surface of the turbine case; and an exit port; and a bypass pipe having an upstream end coupled to the exit port, a downstream end coupled to a low-pressure sink, and a valve disposed between upstream and downstream ends, the valve selectively moveable between a first position which blocks flow between the upstream and downstream ends, and a second position which permits flow between the upstream and downstream ends.

According to another aspect of the invention, the manifold includes a plurality of exit ports, and a plurality of bypass pipes are disposed around the manifold, each bypass pipe having: an upstream end coupled one of the exit ports; a downstream end coupled to a low-pressure sink: and a valve disposed between upstream and downstream ends, the valve selectively moveable between a first position which blocks flow between the upstream and downstream ends, and a second position which permits flow between the upstream and downstream ends.

According to another aspect of the invention, an actuator is coupled to the valve.

According to another aspect of the invention, a clearance control apparatus for a gas turbine engine having a central axis includes: an annular turbine case having forward and aft annular rings protruding radially outward therefrom, wherein at least one of the rings includes an inlet port passing therethrough; an annular cover having a port formed therein, the cover circumscribing the turbine case, with an inner surface of the cover contacting radially-outer faces of the rings, such that the turbine case, the rings, and the cover collectively define a manifold; and a bypass pipe having an upstream end coupled to the exit port, a downstream end coupled to a low-pressure sink, and a valve disposed between upstream and downstream ends, the valve selectively moveable between a first position which blocks flow between the upstream and downstream ends, and a second position which permits flow between the upstream and downstream ends.

According to another aspect of the invention, the cover includes: an aft section surrounding the rings, the aft section including the exit port; and a forward section comprising an annular array of axially-extending, spaced-apart fingers.

According to another aspect of the invention, each finger has a flange disposed at its distal end; the turbine case includes a radially-extending forward mounting flange disposed axially forward of the forward ring; and the flanges of the fingers are connected to forward mounting flange of the turbine case by a mechanical joint.

According to another aspect of the invention, each of the forward and aft rings includes an annular array of holes formed therein, communicating with the manifold.

According to another aspect of the invention, the holes in the rings are disposed at a non-perpendicular, non-parallel angle to the central axis.

According to another aspect of the invention, a shroud is disposed inside the turbine case surrounding a row of turbine blades which are rotatable about the central axis.

According to another aspect of the invention, a method is provided for controlling turbine clearance in a gas turbine engine of the type having: an annular turbine case that surrounds a turbine rotor, the turbine case having an outer surface exposed in engine operation to a constant flow of relatively cool bypass air and an opposed inner surface exposed in engine operation to relatively hotter air; and an annular manifold surrounding a portion of the outer surface of the turbine case and including an inlet port in communication with the outer surface. The method includes: coupling an upstream end of a bypass pipe in fluid communication with the manifold; coupling a downstream end of the bypass pipe in fluid communication with a low-pressure sink; and using a valve disposed between the upstream and downstream ends, positioning the valve during engine operation so as to permit a desired amount of bypass air to flow through the manifold when it is desired to cool the turbine case.

According to another aspect of the invention, during a first engine operating condition, the valve is positioned in a first position such that bypass air cannot flow through the manifold; and during a second engine operating condition, the valve is positioned in a second position so as to permit bypass air to flow through the manifold and thereby cool the turbine case.

According to another aspect of the invention, the manifold includes a plurality of exit ports, and a plurality of bypass pipes are disposed around the manifold, each bypass pipe having: an upstream end coupled one of the exit ports; a downstream end coupled to a low-pressure sink; and a valve disposed between upstream and downstream ends, the valve operable to selectively block or permit flow between the upstream and downstream ends, and the method further includes: during engine operation, positioning each of the valves so as to permit a desired amount of bypass air to flow through the manifold, when it is desired to cool the turbine case.

BRIEF DESCRIPTION OF THE DRAWINGS

The invention may be best understood by reference to the following description taken in conjunction with the accompanying drawing figures in which.

DETAILED DESCRIPTION OF THE INVENTION

The present invention generally provides a suction-based active clearance control system which controls flow using a valve located downstream of an active clearance control manifold.

Figure 1:
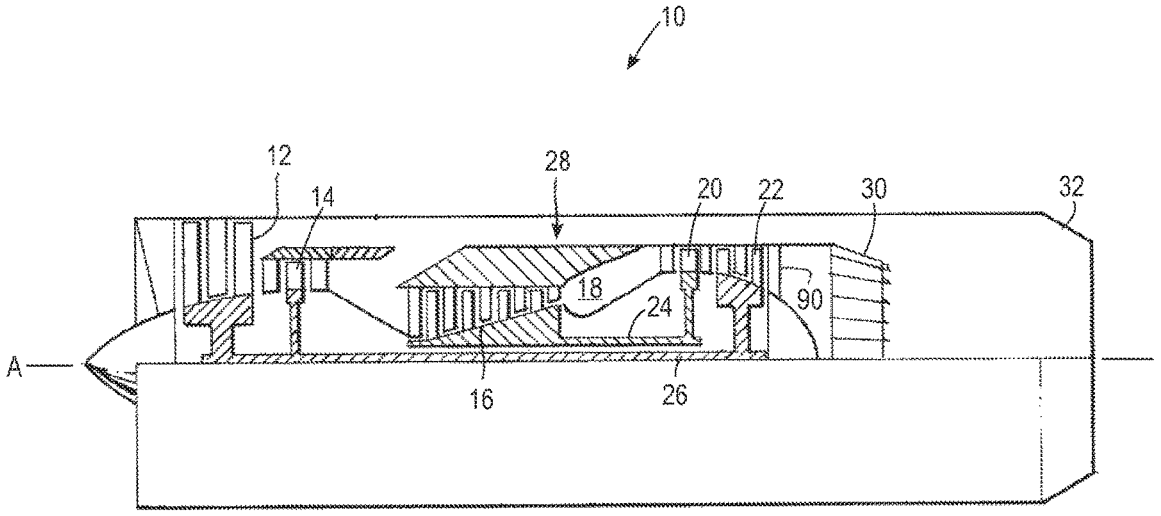
FIG. 1 is a schematic, partially-sectioned view of a gas turbine engine, incorporating an active clearance control apparatus constructed in accordance with an aspect of the present invention.

Now, referring to the drawings wherein identical reference numerals denote the same elements throughout the various views, FIG. 1 depicts schematically a gas turbine 10 engine having a centerline axis "A" and including, among other structures, a fan 12, a low-pressure compressor or "booster" 14, a high-pressure compressor ("HPC") 16, a combustor 18, a high-pressure turbine ("HPT") 20, and a low pressure turbine ("LPT") 22. Collectively the HPC 16, combustor 18, and HPT 20 constitute a "core" of the engine 10. The HPC 16 provides compressed air that passes primarily into the combustor 18 to support combustion and partially around the combustor 18 where it is used to cool both the combustor liners and turbomachinery further downstream. Fuel is introduced into the forward end of the combustor 18 and is mixed with the air in a conventional fashion. The resulting fuel-air mixture is ignited for generating hot combustion gases. The hot combustion gases are discharged to the HPT 20 where they are expanded so that energy is extracted. The HPT 20 drives the high-pressure compressor 16 through an outer shaft 24. The gases exiting the HPT 20 are discharged to the low-pressure turbine 22 where they are further expanded and energy is extracted to drive the booster 14 and fan 12 through an inner shaft 26. A portion of the air exiting the fan 12 bypasses the core, flows through a bypass duct 28, and re-combines with the exhaust gases exiting the core at a mixer 30, before exiting through an exhaust nozzle 32.

In the illustrated example, the engine is a turbofan engine. However, the principles described herein are equally applicable to turboprop and turbojet engines, as well as turbine engines used for other vehicles or in stationary applications.

Figure 2:
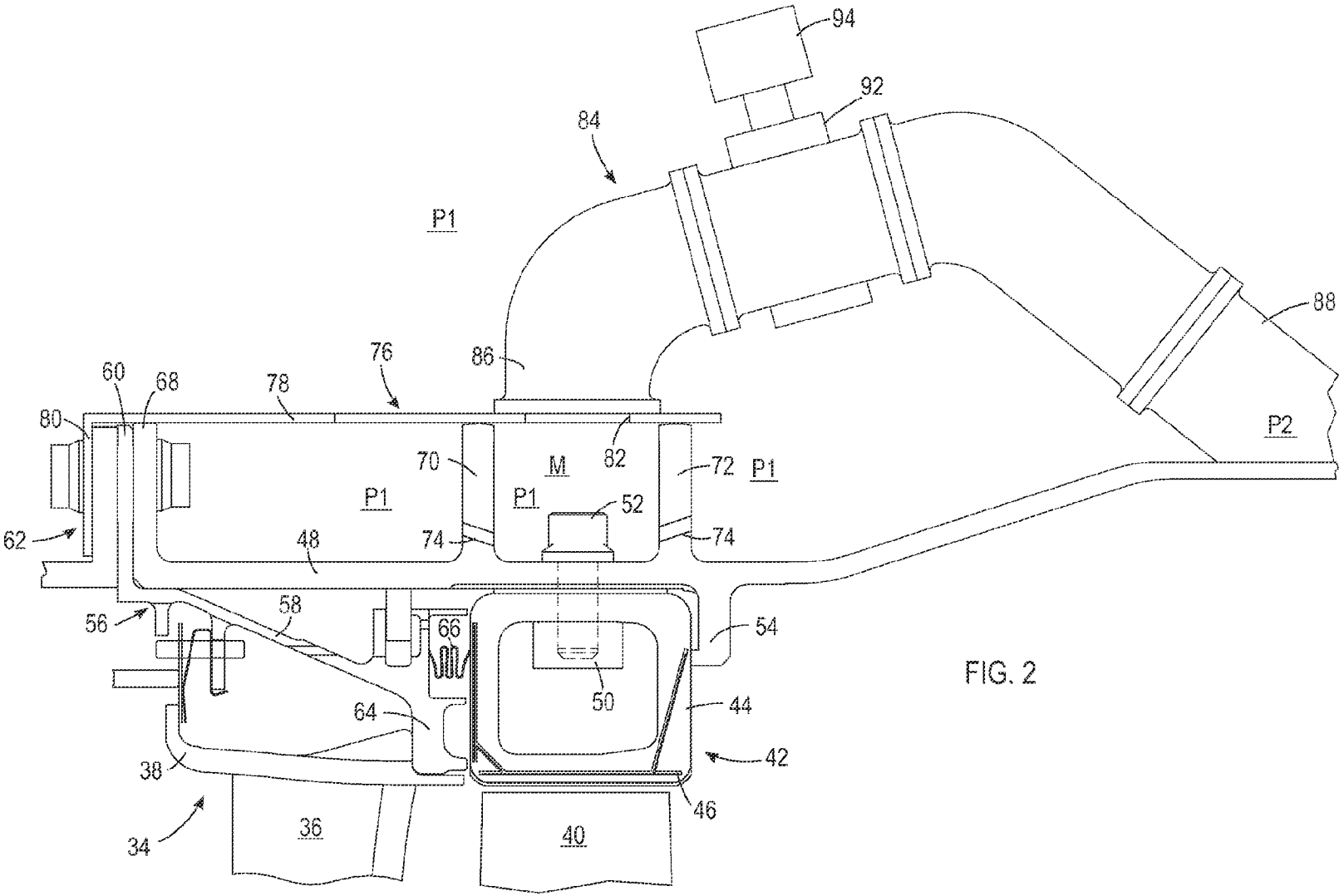
FIG. 2 is a partially-sectioned view of a turbine section of the engine of FIG. 1.

Referring to FIG. 2, The HPT 20 includes a nozzle 34 which comprises a plurality of circumferentially spaced airfoil-shaped stationary turbine vanes 36 that are circumscribed by an annular outer band 38. The outer band 38 defines the outer radial boundary of the gas flow through the turbine nozzle 34. It may be a continuous annular element or it may be segmented. The turbine vanes 36 are configured so as to optimally direct the combustion gases to a downstream rotor.

Downstream of the nozzle 34, the rotor includes a disk (not shown in FIG. 2) that rotates about the centerline axis A and carries an array of airfoil-shaped turbine blades 40. A shroud comprising a plurality of arcuate shroud segments 42 is arranged so as to closely surround the turbine blades 40 and thereby define the outer radial flowpath boundary for the hot gas stream flowing through the rotor.

In the illustrated example, each shroud segment 42 has a hollow cross-sectional shape defined by opposed inner and outer walls, and forward and aft walls.

The shroud segments 42 may be constructed from a ceramic matrix composite (CMC) material of a known type. Generally, commercially available CMC materials include a ceramic type fiber for example SiC, forms of which are coated with a compliant material such as Boron Nitride (BN). The fibers are carried in a ceramic type matrix, one form of which is Silicon Carbide (SiC). Typically, CMC type materials have a room temperature tensile ductility of no greater than about 1%, herein used to define and mean a low tensile ductility material. Generally CMC type materials have a room temperature tensile ductility in the range of about 0.4 to about 0.7%. This is compared with metals having a room temperature tensile ductility of at least about 5%, for example in the range of about 5 to about 15%. The shroud segments 42 could also be constructed from other low-ductility, high-temperature-capable materials.

The shroud segments 42 include opposed end faces 44 (also commonly referred to as "slash" faces). Each of the end faces 44 lies in a plane parallel to the centerline axis A of the engine, referred to as a "radial plane". They may also be oriented so that the plane is at an acute angle to such a radial plane. When assembled and mounted to form an annular ring, end gaps are present between the end faces 44 of adjacent shroud segments 42. Accordingly, an array of seals 46 may be provided at the end faces 44. Similar seals are generally known as "spline seals" and take the form of thin strips of metal or other suitable material which are inserted in slots in the end faces 44. The spline seals 46 span the gaps.

The shroud segments 42 are mounted to a stationary engine structure. In this example the stationary structure is an HPT case 48 which is generally a body of revolution about the centerline axis A. The HPT case 48 has opposed inner and outer surfaces 49, 51 facing the interior and exterior spaces of the HPT case 48, respectively. A hanger 50 or load spreader may be disposed inside each of the shroud segments 42. A fastener 52 such as the illustrated bolt engages the hanger 50, passes through a mounting hole in the shroud segment 42, and clamps or positions the shroud segment 42 in the radial direction.

The turbine case 48 includes a flange 54 which projects radially inward and defines and axially-facing bearing surface. This surface acts as a rigid stop to aft motion of the shroud segments 42.

A nozzle support 56 is positioned axially forward of the shroud segment 42. It has a generally conical body 58. An annular forward flange 60 extends radially outboard from the forward end of the body 58. The forward flange 60 is assembled in a bolted joint 62 (or other type of mechanical joint) to other stationary engine structures which are not the subject of this invention. An annular rear flange 64 is disposed at the aft end of the body 56.

A spring element 66 is disposed between the nozzle support 56 and the shroud segments 42. When assembled, the spring element 66 loads the shroud segments 42 axially aft against the flange 54 of the turbine case 48.

The forward end of the HPT case 48 includes a radially-extending forward mounting flange 68. The forward mounting flange 68 is assembled in the bolted joint 62 Annular, plate-like forward and aft rings 70 and 72 extend radially outward from the HPT case 48. The axial spacing between the rings 70 and 72 is approximately the same as the axial length of a shroud segment 42.

It is noted that, while the present invention is described as applied to an HPT having a resiliently-mounted box-type shroud, the principles described here are applicable to any type of HPT shroud structure.

Figure 3:
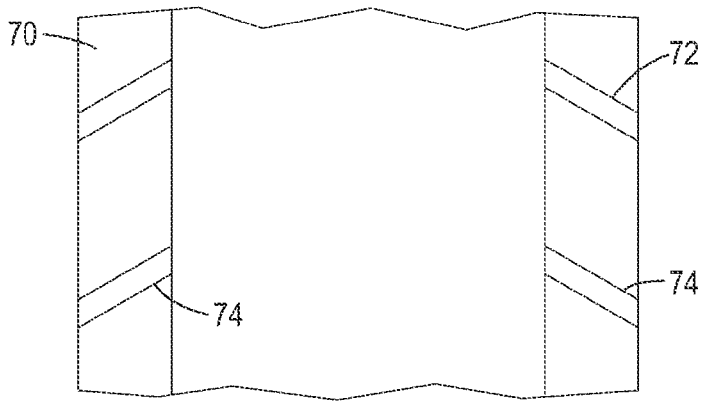
FIG. 3 is a top plan view of a portion of a turbine case, showing a first configuration of holes in a pair of rings.
Figure 4:
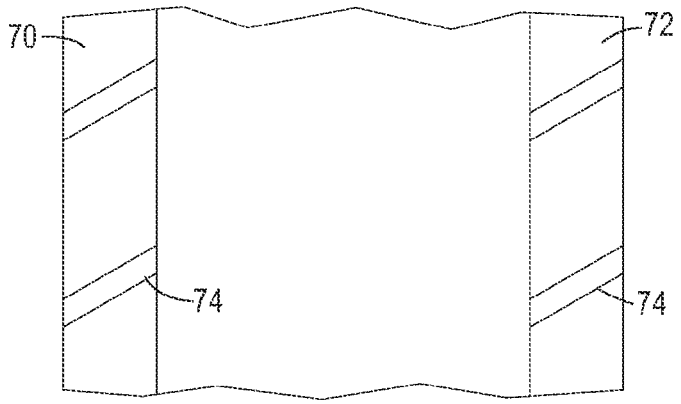
FIG. 4 is a top plan view of a portion of a turbine case, showing a second configuration of holes in a pair of rings.
Figure 5:
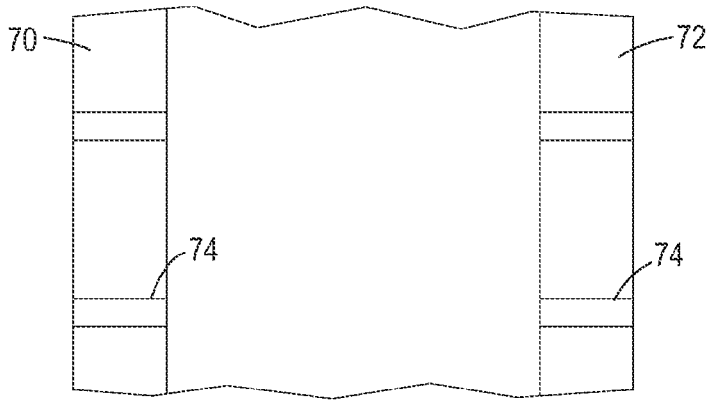
FIG. 5 is a top plan view of a portion of a turbine case, showing a third configuration of holes in a pair of rings.

One or both of the rings 70 and 72 include a plurality of holes 74 formed therein, arranged in an annular array. The holes 74 may extend parallel to the centerline axis A of the engine 10, or they may be angled in either radial or tangential directions, or both. As used herein with respect to the holes 74, the term "angled" indicates that the longitudinal axes of the holes 74 are disposed at an acute angle to the centerline axis A when observed in either a radial plane or a tangential plane, or both. This could also be described as the holes 74 being oriented at a non-parallel, non-perpendicular angle to the centerline axis A in at least one plane. In FIG. 2, the holes 74 are shown angled in a radial direction. In FIG. 3, the holes 74 in the forward ring 70 are angled tangentially, and the holes 74 in the aft ring 72 are angled tangentially but in opposite direction (relative to a direction of flow). In FIG. 4, the holes 74 in the forward ring 70 are angled tangentially, and the holes 74 in the aft ring 72 are angled tangentially but in the same direction. In FIG. 5, the holes 74 are shown parallel to the centerline axis A. The size, spacing, angle, and position of the holes 74, as well as the shape, dimensions, and positions of the rings 70 and 72 may be selected to tailor the thermal performance of the rings 70 and 72 as needed to suit a specific application. In addition to directing air flow, the presence of the holes 74 serves to reduce conductive heat transfer from the HPT case 48 into the rings 70 and 72.

Figure 6:
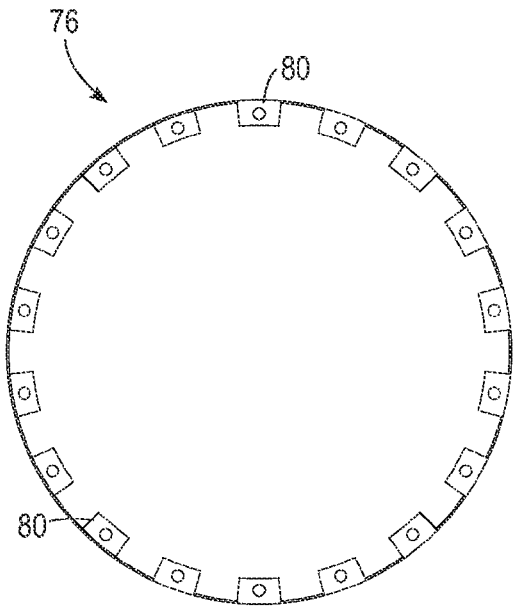
FIG. 6 is a front elevational view of a cover shown in FIG. 2.
Figure 7:
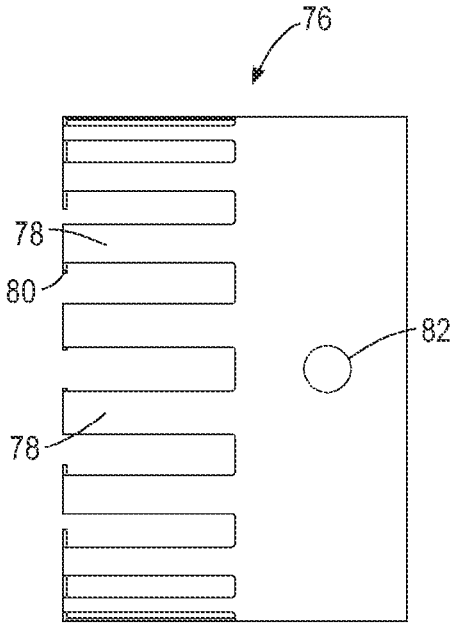
FIG. 7 is a side elevational view of the cover of FIG. 6.

Referring back to FIG. 2, an annular cover 76 surrounds the rings 70 and 72. The cover 76 includes forward and aft sections. As best seen in FIGS. 6 and 7, the forward section comprises an annular array of axially-extending, spaced-apart fingers 78, each finger 78 having a flange 80 at its distal end. The aft section is cylindrical and includes one or more exit ports 82 formed therein. In the illustrated example, there are three exit ports 82 evenly spaced around the periphery of the cover 76. The flanges 80 are clamped in the bolted joint 62 (FIG. 2) and position the cover 76 such that the aft section lies against and surrounds the forward and aft rings 70 and 72. Collectively, the cover 76, the forward and aft rings 70 and 72, and the portion of the HPT case 48 lying between the rings 70 and 72 define an annular manifold "M". It is noted that, in notable contrast to prior art manifold structures, no positive attachment, such as a formed, welded, or brazed joint, is required between the cover 76 and the rings 70 and 72, as the line contact between the rings 70 and 72 and the cover 76 provides adequate sealing for the purposes of the present invention. The manifold includes at least one inlet port for the purpose of admitting airflow therein. In the illustrated example, the The engine 10 is provided with one or more hollow bypass pipes 84. Each bypass pipe 84 has an upstream end 86 that is coupled to the cover 76. More specifically, the bore of the bypass pipe 84 communicates with the port 82 in the cover 76. One bypass pipe 84 is provided for each port 82. Optionally, the bypass pipes 84 may be positively coupled and/or sealed to the cover 76, for example using a welded or brazed joint, or a mechanical connection.

Each bypass pipe 84 has a downstream end 88 that communicates with a pressure "sink" or region of reduced static pressure relative to the region. In the illustrated example, the downstream end 88 of each bypass pipe 84 communicates with the turbine rear frame 90 (see FIG. 1).

Each bypass pipe 84 incorporates a valve 92 of a known type between the upstream end 86 and the downstream end 88. The valve 92 is moveable between a closed position which blocks flow between the upstream and downstream ends 86 and 88, and an open position which permits flow between the upstream and downstream ends 84 and 88. Optionally, the valve 92 may be of a type which can bet positioned in an intermediate position to modulate flow, that is, to permit some amount of flow variable between no flow and maximum flow. The valve 92 may be operable by known means such as an electrical, hydraulic, or pneumatic actuator (an actuator 94 is shown schematically).

During engine operation the tip clearance between the turbine blades 40 and the shroud segments 42 is affected by multiple factors, including (1) rotor elastic growth, (2) casing pressure growth, (3) blade thermal growth, (4) casing thermal growth, and (5) rotor thermal growth. The sequence and magnitude of these effects collectively determines the actual clearance at any particular time.

During engine acceleration from low-speed conditions, the tip clearance shrinks, leading to a minimum clearance, and then increases as time progresses. Such a minimum is termed a "pinch point" and places a limit upon the minimum clearance that can be manufactured into the engine 10. As a result, clearances at conditions other than the pinch point are more open than required. Therefore, to reduce this needlessly large clearance, active clearance control may be employed to control the diameter of the turbine case 48 by flowing the relatively cold bypass air through the manifold M.

At all times when the engine is running, the region surrounding the cover 76 is exposed to fan bypass flow at a first pressure "P1" (this is because the turbine case 48 is exposed to the bypass duct 28). This is true even though no special valves, piping, etc. are used upstream of the manifold M. The openings in the cover 76 and the holes 74 in the forward and aft rings 70 and 72 communicate this pressure to the manifold M and to the bore of the bypass pipes 84 upstream of the closed valves 92. When the valves 92 are closed, the air stagnates in this region and no flow takes place through the bypass pipes 84. The valves 92 would typically be closed during engine acceleration, when the highest priority is to avoid blade rubs.

The downstream ends 88 of the bypass pipes 84 communicate with a pressure "sink," i.e., a region having a prevailing static pressure "P2" which is less than P1, i.e., P1>P2. When the valves 92 are open, this pressure difference drives air flow sequentially from the bypass flowpath, through the openings in the cover 76 between the fingers 78 (and around the aft end of the aft ring 72), through the holes 74 in the forward and aft rings 70 and 72, into the manifold M where it scrubs the outer surface of the HPT case 48, through the exit ports 82, through the bypass pipes 84, and finally out the downstream ends 88 to the pressure sink (e.g. turbine rear frame 90). This flow may be dumped overboard or may rejoin an exhaust flowpath of the engine 10. The valves 92 would typically be opened during steady-state operating conditions, in order to minimize the tip clearances. This type of control, wherein the valves 92 are positioned downstream of the manifold M, may be referred to as "suction-based" active clearance control.

Operation of the clearance valves 92 to control flow through the manifold M, and thus clearance may be carried out using known apparatus and methods. For example, the engine 10 may be provided with one or more temperature and/or clearance measurement sensors (not shown). Input from such sensors may be provided to an electronic controller which uses known algorithms to determine whether the valves 92 should be closed, partially open, or fully open during each phase of engine operation.

The active clearance control apparatus and method described herein has several advantages over prior art systems. It uses fan bypass air as a cooling fluid. This bypass flow is available for use without the need for complex, expensive valves and piping upstream of the point of use. Furthermore, the manifold structure is much simpler than prior art systems using separate fabricated manifolds for active clearance control.

The foregoing has described a clearance control structure and method for a gas turbine engine. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A clearance control apparatus for a gas turbine engine, the clearance control apparatus comprising:
- an annular turbine case having opposed inner and outer surfaces;
- an annular manifold surrounding a portion of the turbine case, the manifold comprising:
  - an inlet port in fluid communication with the manifold and the outer surface of the turbine case; and
  - an exit port; and
- a bypass pipe comprising an upstream end coupled to the exit port, a downstream end coupled to a low-pressure sink, and a valve disposed between upstream and downstream ends, the valve selectively moveable between a first position which blocks flow between the upstream end and the downstream end, and a second position which permits flow between the upstream end and downstream end;
- wherein the cover further comprises:
- an aft section surrounding the rings, the aft section comprising the exit port; and
- a forward section comprising an annular array of axially-extending, spaced-apart fingers; and;
- wherein each finger comprises a flange disposed at its distal end,
- the turbine case further comprises a radially-extending forward mounting flange disposed axially forward of the forward ring, and
- each of the flange of each of the finger is connected to forward mounting flange of the turbine case by a mechanical joint.

2. The apparatus of claim 1 wherein an actuator is coupled to the valve.

3. A clearance control apparatus for a gas turbine engine having a central axis, the clearance control apparatus comprising:
- an annular turbine case comprising a forward ring and an aft annular ring protruding radially outward therefrom, wherein at least one of the rings comprises an inlet port passing therethrough;
- an annular cover comprising a port formed therein, the cover circumscribing the turbine case, with an inner surface of the cover contacting radially-outer faces of the rings, such that the turbine case, the rings, and the cover collectively define a manifold; and
- a bypass pipe comprising an upstream end coupled to the exit port, a downstream end coupled to a low-pressure sink, and a valve disposed between the upstream end and the downstream end, the valve selectively moveable between a first position which blocks flow between the upstream end and the downstream end, and a second position which permits flow between the upstream end and the downstream end;
- wherein the cover further comprises:
- an aft section surrounding the rings, the aft section comprising the exit port; and
- a forward section comprising an annular array of axially-extending, spaced-apart fingers; and;
- wherein each finger comprises a flange disposed at its distal end,
- the turbine case further comprises a radially-extending forward mounting flange disposed axially forward of the forward ring, and
- each of the flange of each of the finger is connected to forward mounting flange of the turbine case by a mechanical joint.

4. The apparatus of claim 3, wherein each of the forward ring and the aft ring comprises an annular array of holes formed therein, communicating with the manifold.

5. The apparatus of claim 4, wherein the holes in the rings are disposed at a non-perpendicular, non-parallel angle to the central axis.

6. The apparatus of claim 3, wherein:
- the manifold comprises a plurality of exit ports, and
- a plurality of bypass pipes are disposed around the manifold, each bypass pipe comprising:
  - an upstream end coupled one of the exit ports;
  - a downstream end coupled to a low-pressure sink; and
  - a valve disposed between the upstream end and the downstream end, the valve selectively moveable between a first position which blocks flow between the upstream end and the downstream end, and a second position which permits flow between the upstream end and the downstream end.

7. The apparatus of claim 3, wherein an actuator is coupled to the valve.

8. The apparatus of claim 3, further comprising a shroud disposed inside the turbine case and surrounding a row of turbine blades which are rotatable about the central axis.

* * * * *